US005929737A

United States Patent [19]

Zinders et al.

[11] Patent Number: 5,929,737

[45] Date of Patent: Jul. 27, 1999

[54] CONTROLLABLE INDUCTOR

[75] Inventors: Gunnar Zinders, Smedjebacken; Tommy Holmgren; Björn Sandin, both of Ludvika; Stefan Valdemarsson, Västerås; Dan Elofsson, Ludvika, all of Sweden

[73] Assignee: Asea Brown Boveri AB, Vasteras, Sweden

[21] Appl. No.: 08/896,803

[22] Filed: Jul. 18, 1997

[51] Int. Cl.[6] ..... H01F 7/00; H01F 9/00; H01F 85/00; H01F 71/20

[52] U.S. Cl. ..... 336/155; 336/59; 336/60; 336/207; 336/223

[58] Field of Search ..... 336/55, 57, 59, 336/60, 221, 223, 225, 227, 229, 207

[56] References Cited

U.S. PATENT DOCUMENTS 2,942,213 6/1960 Camilli et al. ..... 336/60

3,008,108 11/1961 Baker et al. ..... 336/229

FOREIGN PATENT DOCUMENTS 2099226 5/1982 United Kingdom .

*Primary Examiner*—Michael L. Gellner
*Assistant Examiner*—Anh Mai
*Attorney, Agent, or Firm*—Watson Cole Grindle Watson P.L.L.C.

[57] ABSTRACT

A controllable inductor including at least one tubular core (10), a main winding (5) surrounding the core and a control winding (11) running substantially axially through said core and returning substantially axially outside thereof between said core and said main winding. The control winding is divided into a plurality of separate part control windings (12). The cross section of the part control windings is formed in a way that at least some adjacent part control windings inside the core are separated by means of a spacing (20, 26), which is at least partly defined by substantially parallel surfaces (16, 17) of these part control windings.

19 Claims, 3 Drawing Sheets

CONTROLLABLE INDUCTOR

FIELD OF THE INVENTION AND PRIOR ART

The present invention relates to a controllable inductor including at least one tubular core, a main winding surrounding the core and a control winding running substantially axially through said core and returning substantially axially outside thereof between said core and said main winding, said control winding being divided into a plurality of separate part control windings.

Such a controllable inductor is previously known from, for example, the applicant's WO 94/11891. The definition of "controllable" is to be given such a wide meaning, that it also comprises the case that a control current, which is constant over time passes through the control winding.

A controllable inductor of this type connected in series with a capacitor functions as a so-called harmonic filter in connection with a high voltage station for converting direct voltage to alternating voltage and vice versa, its main winding being connected to the high voltage net over a capacitor, usually on the alternating voltage side. In such a controllable inductor the permeability of its core and thereby the inductance is adjusted with the aid of the cross-magnetization generated inside the core by causing direct current to run through said control winding, wherein the inductance of the inductor may be adjusted to exactly that frequency an overtone generated in the high voltage net is having for an effective fade-out thereof while causing small energy losses in the inductor.

The different part control windings of such a controllable inductor are heated partly by the eddy-current losses generated therein because of that the magnet flux generated by the main winding and running substantially longitudinal with respect to the core, passes through said control winding wires, and partly by the direct current running through the wires with the intention to control the inductance of the inductor. To decrease the eddy-current losses every part control winding is produced with a number of thin wires, as the power dissipation per unit volume is proportional to the square of the thickness of the metal perpendicular to the flux direction for the metal effected by a certain magnetical flux density. From an economical point of view it is important to dimension the inductor and the control winding in such a way that a high magnetic energy density is achieved in the tubular core, so that the inductor receives a low weight and thereby achieving a low cost. The storable energy density in the core is thereby inverse proportional to the permeability of a specific flux density and thus it is important to achieve the highest possible number of ampere-turns of the control winding passing in the core at a specific winding space. This implies of course high heat release and the possibilities to cool the control winding may be decisive for the achievable number of ampere-turns. It is thus desirable to form the core as compact as possible, i.e. with as small inner room as possible, while filling this room with said part control windings to as high degree as possible and thereby achieving the highest possible number of ampere-turns without causing such temperatures in the part control windings or in the adjacent components that they will be damaged.

In previously known inductors of this kind, the part control windings have usually been produced with a substantially circular cross section, the part control windings desirably being arranged to circumferentially abut against each other for a good level of filling of the inner room of the core. In this way air channels are formed between different part control windings enabling cooling air to be blown or drawn therethrough for heat exchange with the surfaces of the part control windings. By this embodiment of the part control windings the so formed air channels between the part control windings get a too large cross section at some places and they will completely disappear, not causing any cooling at all at some surfaces of the part control windings due to that the part control windings are abutting each other along a substantially axially extending line. It would of course be possible to arrange some type of distance element that keeps these part control windings separate from each other, but in that way the, channels would obtain an even larger dimension of the cross section at some places and it is known that the heat transfer number increases if the air passing by is forced to pass closer to the surface to be cooled, i.e. if the channels are more narrow. By instead providing a very large number of relatively thin part control windings and arranging these windings somewhat separate from each other, the producing costs would become very high, and the degree of filling of the inner room of the core would further deteriorate.

SUMMARY OF THE INVENTION

The object of the present invention is to provide a solution of the above discussed problem by providing a controllable inductor that enables a substantially higher number of ampere-turns than by previously known controllable inductors at a specific winding space inside the core by enabling a good filling of this space and at the same time provide effective cooling.

This object is achieved according to the invention by way of providing the part control windings of the inductor defined in the introduction with such a cross section that at least some adjacent part control windings running inside the core are separated by a spacing at least partly defined by substantially parallel surfaces of these part control windings.

Thanks to such a design of the cross section of the part control windings obtaining such spacings defined by substantially parallel surfaces, it will be possible to obtain a very good filling of the inner room of the core, as these substantially parallel surfaces may be allowed to run relatively close to each other, while the cooling air may be distributed over the surfaces defining the spacing and thanks to the narrowness of the spacing, the cooling may be very effective and thereby admitting a very high heat release per unit volume in the part control windings. In accordance there will be provided possibilities to achieve a large surface available for cooling per unit volume of the control winding.

According to a preferred embodiment of the invention the main part of the adjacent part control windings inside said core are separated by a spacing, which is at least partly defined by substantially parallel surfaces of said part control windings. The advantages mentioned in the previous section will in this way increase even more and they will be increased to their largest extent according to another preferred embodiment of the invention where all part control windings inside the core are separated by a spacing defined by at least substantially parallel surfaces of these part control windings.

According to another preferred embodiment of the invention the part control windings have such a cross section that at least some adjacent part control windings outside said core are separated by a spacing, which is at least partly defined by substantially parallel surfaces of said part control windings. By this design of the portions of the part control windings running outside the core it will be possible to make the inductor more compact also outside the core and yet obtain a high maximum number of ampere-turns and enabling enough cooling.

According to another preferred embodiment of the invention each part control winding running closest outside and/or inside said core has surfaces extending substantially parallel to surfaces of the envelope of said core for defining a spacing therebetween. It is in this way possible to obtain a desired distance between the part control winding and the core respectively for obtaining the necessary cooling of the part control winding, but thanks to said substantially parallel surfaces and the advantages connected thereto with respect of the cooling, this spacing may be made so "narrow" that a very good filling of the spacing will be obtained inside and outside the core.

According to another preferred embodiment of the invention said spacings are substantially completely defined by substantially parallel surfaces of adjacent part control windings, which makes it possible to obtain a very uniform distribution of the cooling air over the complete control winding volume, allowing a high heat release per unit volume in combination with a high degree of filling of the inner room of the core.

According to another very preferred embodiment of the invention at least some of said part control windings have a form tapering substantially wedge-like towards the centre of said core as seen in a radial cross section through a portion of said windings running inside said core. Thanks to that the respective part control winding has been arranged with such a cross section form, the room inside the core may be filled to a large extent while obtaining spacings defined by substantially parallel surfaces between adjacent part control windings, receiving a circular segment character, and it will be possible to obtain a very large surface available for cooling per unit volume of the control winding in combination with a high degree of filling of the inner room of the core.

According to another preferred embodiment of the invention, the inductor comprises part control windings, which have a portion thereof running inside said core having a narrow, substantially elongated form in radial direction with respect to said core as seen in a radial cross section. In this way a very advantageous relationship will be obtained between the surface accessible for cooling and the volume of the control winding. This embodiment is in combination with the embodiment considering the form tapering wedge-like of the part control windings is especially suitable for obtaining a high maximum number of ampere-turns at a specific winding space.

According to another preferred embodiment of the invention, the inductor comprises several part control windings located inside each other and running in radial direction with respect to said core and that these part control windings define spacings between each other by substantially tangentially and axially directed surfaces thereof. This embodiment is especially suitable for large inductors where the part control windings in this way may be formed more handy while being divided into a larger number while maintaining all the above penetrated advantages of the invention.

According to a further development of the last mentioned embodiment the number of part control windings inside said core increases in radial direction from the centre of the core and outwards along circles with the centre of the core as the centre for filling the inner room of said core. In this way it is possible to obtain a very high degree of filling of the inner room of the core while ensuring good cooling possibilities while in this way obtaining a good filling of circular sectors of the inner room of the core and at the same time obtaining said spacings between the single part control windings.

Further advantages and advantageous characteristics of the invention will be apparent from the following description and the other depending claims.

BRIEF DESCRIPTION OF THE DRAWINGS

With reference to the appended drawings, below follows a description of the preferred embodiments of the invention cited as an example. In the drawings.

DETAILED DESCRIPTION OF A PREFERRED EMBODIMENT OF THE INVENTION

Figure 1:
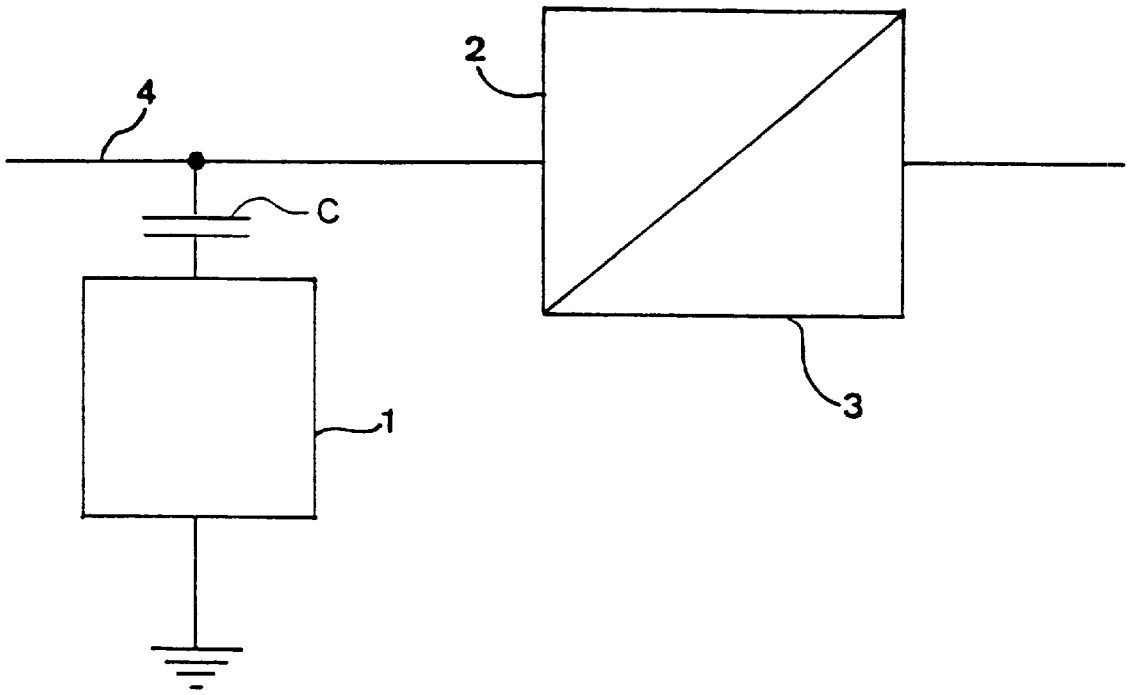
FIG. 1 illustrates in a very schematical block scheme a field of application of an inductor of the type according to the invention, FIG. 2 a partly cut, simplified view illustrating the general construction of a controllable inductor formed according to a preferred embodiment of the invention.

FIG. 1 schematically illustrates how a controllable inductor 1 according to the invention may be connected over a capacitor C to the alternating voltage side 2 of a station 3 for converting high voltage direct current (HVDC) to alternating current and inversely alternating current to direct current. In connection to such stations different overtones are obtained, which superimpose the alternating current leaving the station and these overtones may disturb other apparatuses coupled to the net. The controllable inductor works in conjunction with a capacitor as a harmonic filter fading out these overtones, the filter being intended to have a minimum impedance at exactly the frequency that the overtone has, that is intended to be faded out. Different loads on the net 4 at different times of the day may however cause somewhat varying frequencies of the alternating current, which makes it important that the inductance of the inductor may be controlled to all the time having the minimum of the impedance at the overtone frequency in question, the inductor thereby being connected to a control system for automatically adjusting the control current of the inductor and thereby its inductance for minimising the impedance of the filter at the frequency in question.

Figure 2:
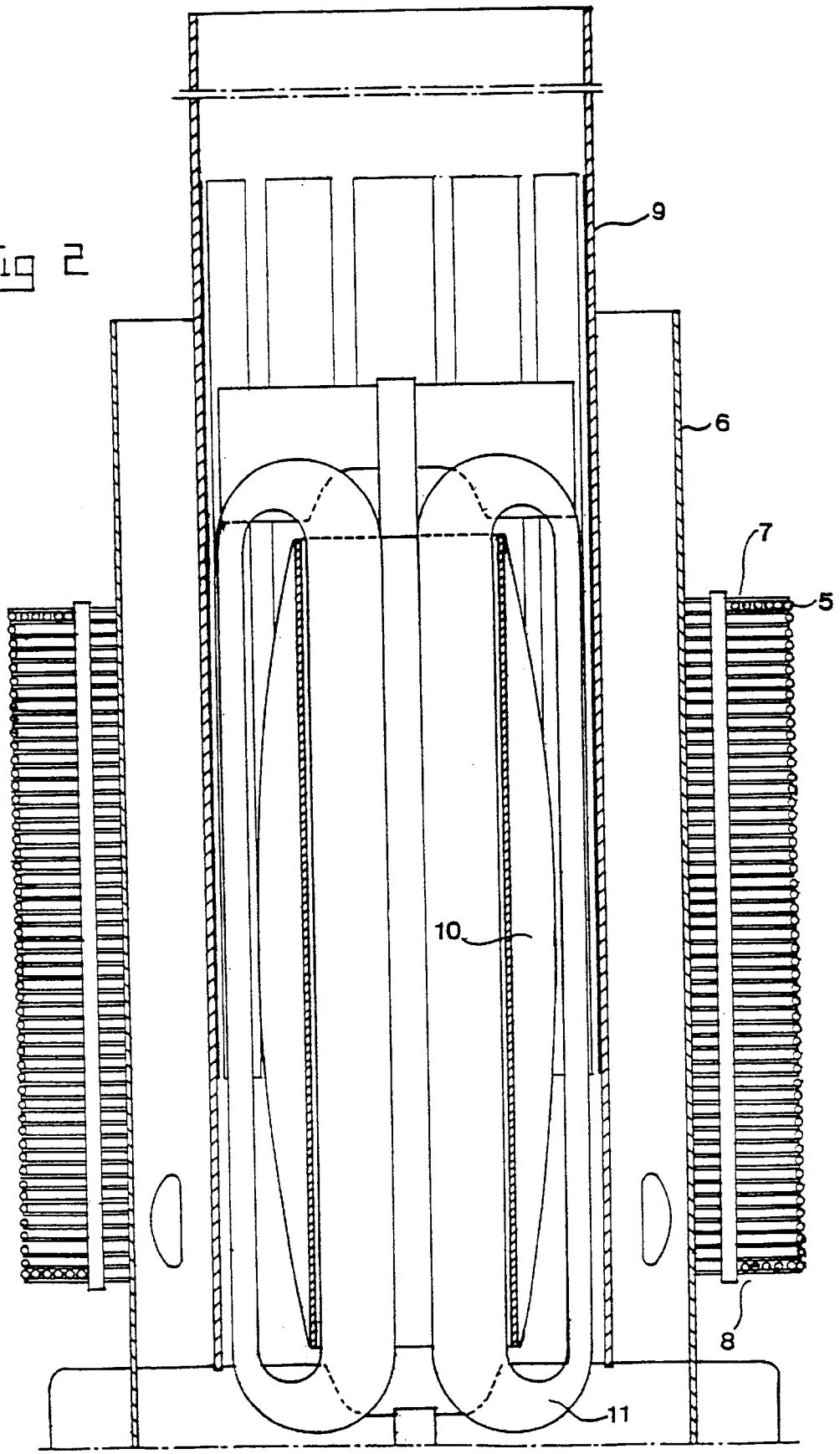

The general construction of a controllable inductor according to a preferred embodiment of the invention will now be described with reference to FIG. 2. The inductor has a main winding 5 connected to the high voltage net over capacitor, the main winding being wound in layers at a distance outside a cylinder 6 of electrical insulating material. The main winding 5 has one end 7 being on a high potential, the voltage thereby falling in direction towards the opposite lower end 8 in FIG. 2, said lower end being on ground potential. A cylinder 9 of electrical insulating material is arranged inside the cylinder 6 and running coaxially against the same. A core 10 of magnetic material is arranged in the room defined by the cylinder 9, running coaxially against said cylinder. This core has a partly conical form at its ends, the form being intended to decrease the eddy-current losses caused by the alternating longitudinal magnet flux generated in the core because of the alternating overtone current in the main winding 5. This phenomena is described in the applicant's WO 94/11891. A controllable winding 11, formed by several separate part control windings, passes substantially axially through the core and returning parallel to the axis of the core into the room between the core and the insulating cylinder 9 in a closed loop. The control winding 11 is connectable to a direct current source for transmitting a direct current through the same, which direct current will generate a tangentially directed magnet flux in the core running across the main flux and in this way decrease its permeability for the longitudinal magnet flux from the main winding. By increasing this direct current it is possible to decrease the permeability of the core and thereby decreasing the inductance of the inductor. A lower permeability of the core will also bring about a higher possible storing of energy therein per unit volume, so that the inductor may be made more compact. The power dissipation per unit volume due to a magnet flux passing across surfaces of a metal object is proportional to the square of the thickness of the object measured perpendicular to the flux direction, implying the core 10 to being produced by very thin sheets wound in several turns, while the control winding is formed by a large number of thin wires. The heat release in the control winding will thereby be decreased due to eddy-current losses. Heat will however also be released in the control winding due to the direct current passing through the control winding and this heat release is in general considerably larger than said eddy-current losses. To be able to make the inductor as compact and thereby as price-worthy as possible it is desirable to obtain as high number of ampere-turns as possible for a specific space of the control winding, the size of the control winding depending on that a high degree of filling of the available space will be obtained in combination with good cooling characteristics.

Figure 3:
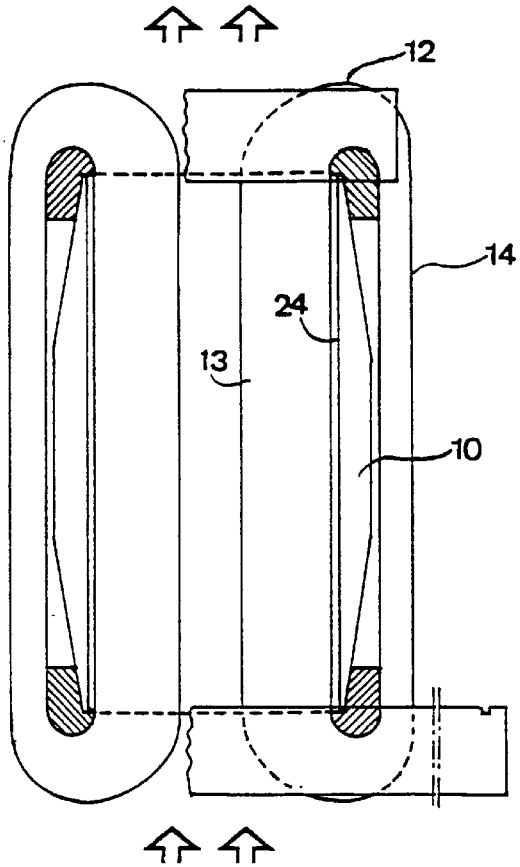
FIG. 3 is a view according to the view in FIG. 2 of the control winding of the inductor according to FIG. 2.

This is precisely the object that the invention is trying to obtain, and a preferred embodiment of a control winding for obtaining this object will now be explained with reference to FIGS. 3–5. The respective part control winding 12 has an inner portion 13 passing substantially axially through the inner room 38 of the core 10 as well as a substantially axially running outer portion 14 returning outside of the core, which portions form a closed coil, a direct current being able to forced to flow through the coil with not shown means in order to cause a tangentially directed magnet flux in the core, said flux running across the main flux, which is indicated with the arrow 15.

The part control windings have such a cross section that two adjacent part control windings define spacings 20, 21 inside as well as outside of the core between each other by way of mutually substantially parallel surfaces 16, 17, 18, 19. Said surfaces 16, 17, 18, 19 are extending substantially in radial and axial direction. In order to obtain this, the inner as well as the outer portion has one substantially wedge-formed cross section as seen in radial direction, the insignificant tapering taking place at the outer portion inwardly towards the core may also be represented as a substantially wedge-formed cross section. In this way it is possible to obtain relatively small spacing distances between the different part control windings, obtaining a high degree of filling of the winding room. At the same time it is very advantageous to distribute cooling air forced substantially axially through said spacings, through said substantially parallel surfaces very uniformly in the entire control winding volume while avoiding local overheating. The "narrow" spacings between adjacent part control windings obtained in this way, will contribute to an improved heat transmission from the part control windings to the cooling air as the heat transmitting constant is higher for cooling air that passes closer to the surfaces in question than further away.

Said advantages will also be obtained by way of the portion 14 running outwardly of the core as well as the inner portion 13 of the respective part control winding has surfaces 22, 23 extending substantially parallel with surfaces of the envelope of the core for defining a spacing 24, 25 respectively therebetween.

Figure 4:
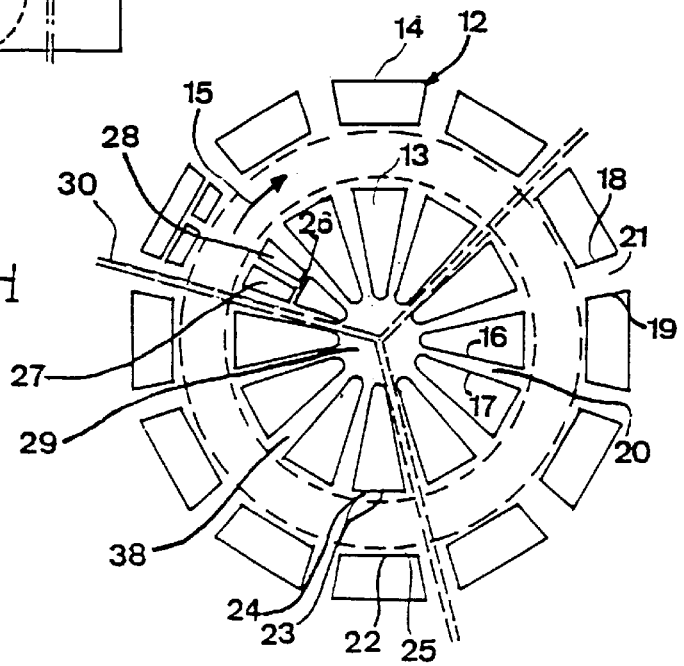
FIG. 4 is a view in a radial cross section, i.e. usually from above, schematically illustrating the design of the control winding of the preferred embodiment of the inductor in FIG. 2.

FIG. 4 shows how a plurality of part control windings could be arranged with respect to the core in radial direction inside each other, and that these part control windings between each other define spacings 26 through substantially tangentially and axially directed surfaces of the same, except for that the adjacent part control winding portions 27, 28 through substantially parallel surfaces define spacings between each other. The same is also valid for the control winding portions extending outside the core, where however the number of part control windings decrease outwardly, while the number of part control windings inside the core increase in radial direction from the centre of the core. This alternative embodiment is most probably especially suitable for large inductors, where the different part control winding coils will be as easy as any to handle, because them being divided in this way.

The part control windings will be kept in place while defining said spacings between each other and the core through suitable distance parts, as a boat-steering-wheel-like rubber part arranged centrally in the core at 29, which rubber part having tips projecting into between each control winding. A support cross 30 arranged in order to unit the complete inductor is also indicated in FIG. 5.

By the embodiment of the different part control windings according to the invention it is possible to obtain a very high number of ampere-turns at a specific winding space thanks to the obtainable high degree of filling of the winding space and the very high surface/volume relation of the control winding and the obtained excellent heat transmitting characteristics between these surfaces and the cooling air thanks to the uniformly distributed cooling air in the narrow spacings. A very high heat release per unit volume may in this way be allowed. Because of the above mentioned characteristics the inductor may be constructed more compact and thus be produced to a lower cost.

Figure 5:
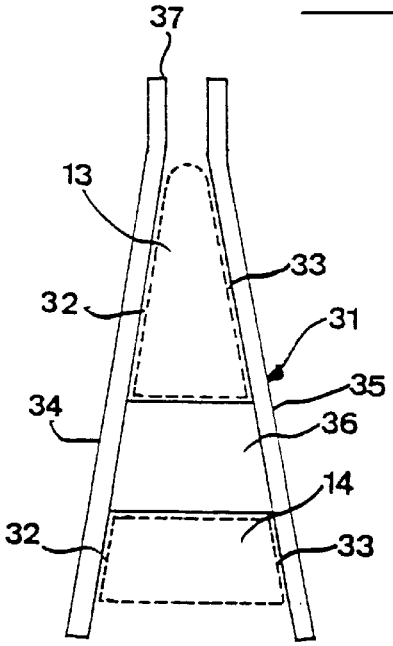
FIG. 5 is a simplified view of a mould for obtaining the part control windings shown in FIG. 4.

A mould 31 for producing a part control winding according to the invention is shown in FIG. 5. This mould 31 has two elements 34, 35 defining a spacing between each other and provided with inner form defining surfaces 32, 33 converging in a direction towards each other and a distance part 36 dividing said spacing and mutually connecting the elements and arranged to receive elongate electrical conductors wound surrounding the elements while filling the spacings on each side thereof for obtaining a part control winding with a two portions 13, 14 with a substantially wedge-formed cross section. A production of a part control winding according to the invention takes place with the aid of this mould 31 in the following way. Preferably such a coil with a number of parallel wires is wound, resulting in that the number of turns of winding is minimised and that there is a possibility for adaptation to the apparatus that is going to generate the control current running through the coil. The coil is thereby preferably wound with a wire provided with an outer thermoplastic layer of glue, so-called bakable wire. When the winding is applied, it might be necessary to force the wires into the spacing between the elements 34 and 35 with a suitable tool at the more narrow end 37 of the mould in order to completely fill the spacing therebetween. The form is thereafter fixed by way of heating the complete coil to a temperature above the melting temperature of the glue layer, so that the coil forms a stable mechanical unit when it is cooled down. A heating like that may take place either by way of conducting a direct current through the coil and the resistive losses will heat it up or by way of heating the coil in an oven. As an alternative to the use of a winding mould with the described design, it is also possible to form the winding around a mould with for example a rectangular cross section and thereafter forming the coil obtained after the baking to a wedge-form in a subsequent pressing.

The invention is of course not in any way limited to the above described preferred embodiment, but a number of possibilities to modifications thereof should be apparent to a man skilled in the art, without departing from the scope of the invention.

For example it would be possible to use a completely different number of part control windings compared to what is shown in the Figures, and it would also be possible that some spacings not being defined by substantially parallel directed surfaces, even if this is very advantageous and preferable.

Furtheron the inner part winding portion could for example have said spacings arranged with respect to adjacent part control winding portions and/or have a substantially wedge-formed cross section, while the outer portion possibly could lack these characteristics, in case the cooling problems outside the core would lack importance.

The definition "substantially parallel surfaces" in the claims includes at least all angles between such surfaces below 20°. These surfaces do not either have to extend in one plane, but they could have a certain arc-form.

The definition "tangentially" in the claims is intended to include all directions parallel to a tangent to the core, which is apparent from the above description.

We claim:

1. A controllable inductor including at least one tubular core, a main winding surrounding the core and a control winding running axially through said core and returning axially outside thereof between said core and said main winding, said control winding being divided into a plurality of separate part control windings, wherein said part control windings have a cross section such that adjacent portions of said part control windings inside said core are separated by a spacing including parallel surfaces of said part control windings.

2. An inductor according to claim 1, wherein the main part of the adjacent part control windings inside said core are separated by a spacing, which is at least partly defined by parallel surfaces of said part control windings.

3. An inductor according to claim 1, wherein the adjacent part control windings inside said core are separated by a spacing, which includes parallel surfaces of said part control windings.

4. An inductor according to claim 1, wherein said parallel surfaces comprise surfaces extending radially and axially with respect to said core.

5. An inductor according to claim 1, wherein said part control windings have such a cross section that at least some adjacent part control windings outside said core are separated by a spacing, which includes parallel surfaces of said part control windings.

6. An inductor according to claim 1, wherein each part control winding running closest outside and inside said core has surfaces extending parallel to surfaces of said core for defining a spacing therebetween.

7. An inductor according to claim 1, wherein it comprises adjacent part control windings, which have spacings defined therebetween by surfaces thereof extending tangentially and axially with respect to said core.

8. An inductor according to claim 1, wherein said spacings are defined by substantially parallel surfaces of adjacent part control windings.

9. An inductor according to claim 1, wherein at least some of said part control windings have a form tapering wedge-like towards the centre of said core in a radial cross section through a portion of said windings running inside said core.

10. An inductor according to claim 1, wherein a portion of said part control windings have a form tapering radially inwardly wedge-like towards said core through a portion of said windings running outside said core.

11. An inductor according to claim 1, wherein it comprises part control windings, which have a portion thereof running inside said core having a narrow, elongated form in radial direction with respect to said core.

12. An inductor according to claim 1, comprising several part control windings located inside each other and running in radial direction with respect to said core and that said part control windings define spacings between each other by tangentially and axially directed surfaces thereof.

13. An inductor according to claim 12, wherein the number of part control windings inside said core increases in radial direction from the centre of the core and outwards along circles with the centre of the core as the centre for filling the inner room of said core.

14. An inductor according to claim 1, wherein said part control windings are formed to fill said core.

15. An inductor according to claim 1, wherein said spacing are narrower in a radial cross section than the average thickness of said part control windings.

16. A controllable inductor including a tubular core having a central axis, a main winding surrounding the core and a control winding including portions running axially within said core and returning axially outside thereof between said core and said main winding, said control winding being divided into a plurality of separate part control windings disposed in spaced apart relation circumferentially about the central axis, adjacent ones of said part control windings have parallel confronting surfaces defining the space therebetween.

17. An inductor according to claim 16, wherein said confronting surfaces extend radially and axially with respect to said core.

18. An inductor according to claim 17, wherein each of said part control windings have the shape of a wedge with a relatively narrow inner portion and a relatively wide radially outer portion.

19. An inductor according to claim 18, wherein each wedge has a pair of said confronting surfaces joining the inner and outer portions.

* * * * *